US007059536B2

(12) United States Patent
Schneider et al.

(10) Patent No.: US 7,059,536 B2
(45) Date of Patent: Jun. 13, 2006

(54) AIR CIRCULATION SYSTEM

(75) Inventors: Stephen M. Schneider, Feeding Hills, MA (US); Anthony C. Novak, Granville, MA (US)

(73) Assignee: Mestek, Inc., Westfield, MA (US)

( * ) Notice: Subject to any disclaimer, the term of this patent is extended or adjusted under 35 U.S.C. 154(b) by 58 days.

(21) Appl. No.: 10/445,862

(22) Filed: May 27, 2003

(65) Prior Publication Data

US 2004/0072535 A1 Apr. 15, 2004

Related U.S. Application Data

(60) Provisional application No. 60/397,216, filed on Jul. 19, 2002.

(51) Int. Cl.
*B60H 1/00* (2006.01)

(52) U.S. Cl. ..... 237/2 A; 454/229

(58) Field of Classification Search ..... 237/2 A, 237/50, 53, 46; 73/861.66; 236/91 F
See application file for complete search history.

(56) References Cited

U.S. PATENT DOCUMENTS

| | | | | | |
|---|---|---|---|---|---|
| 4,364,512 | A * | 12/1982 | Morrison | 236/9 A |
| 4,428,529 | A * | 1/1984 | Bentsen | 236/49.4 |
| 4,453,419 | A * | 6/1984 | Engelke | 73/861.66 |
| 4,817,864 | A * | 4/1989 | Payne | 236/49.4 |
| 5,005,636 | A * | 4/1991 | Haessig | 165/214 |
| 5,707,005 | A * | 1/1998 | Kettler et al. | 236/49.3 |
| 5,791,408 | A * | 8/1998 | Seem | 165/250 |
| 6,126,540 | A * | 10/2000 | Janu et al. | 454/229 |
| 6,227,961 | B1 * | 5/2001 | Moore et al. | 454/229 |
| 6,431,457 | B1 * | 8/2002 | Dirkes, II | 236/11 |

* cited by examiner

*Primary Examiner*—Derek S. Boles
(74) *Attorney, Agent, or Firm*—McCormick, Paulding & Huber LLP

(57) ABSTRACT

An air circulation system for use with or without ductwork having an outside air stream and a return air stream includes a controller and a return damper apparatus operatively connecting the return air stream to the controlled environment. The air circulation system further includes a heating unit and an air mass sensor disposed adjacent to the return damper apparatus. The air mass sensor selectively and directly detecting a ventilation rate of air moving through the return damper apparatus and communicates the ventilation rate to the controller which selectively modulates operation of the heating unit in dependence upon the ventilation rate.

25 Claims, 5 Drawing Sheets

AIR CIRCULATION SYSTEM

CROSS REFERENCE TO RELATED APPLICATIONS

This application claims the benefit of U.S. Provisional Application Ser. No. 60/397,216, filed on Jul. 19, 2002, herein incorporated by reference in its entirety.

FIELD OF THE INVENTION

This invention relates in general to an air circulation system, and deals more particularly with an air circulation system, which controls the rise in temperature of the supply air stream relative to the amount of recirculated air in the air circulation system.

BACKGROUND OF THE INVENTION

Air circulation systems have become integral components in a wide variety of building applications, both residential and commercial. Typically, air circulation systems comprise a duct system in combination with a fan or blower and enable the selective, and oftentimes constant, recirculation of air. The circulation, or recirculation, of air may be utilized to promote a specific pressure regimen within the building, such as to provide a positive building pressure, or may instead be utilized to assist in the removal of harmful air-borne contaminants or to provide heating or air conditioning to the building as a whole. Of course, air circulation systems may be designed to accomplish one or more of these objectives.

Heating components are typically utilized in conjunction with air circulation systems to provide an influx of heat to the recirculated air, upon demand, or as a function of the operation parameters of the overall air circulation system.

Although many different types of heating components are known, direct fired heating units are oftentimes utilized to provide the necessary infusion of heat to an air circulation system. Direct fired heating units typically utilize burners, or the like, oriented in series with the duct system and act to directly heat a circulated air mass as it passes through the burner, the heated air mass being subsequently delivered to selected portions of the building. Typically, these direct fired heating units are fueled by natural gas or propane. These systems, however, are somewhat problematic as the fuel utilized by a given burner apparatus also inherently passes the by-products of combustion into the air mass itself during the heating process, thus leading to contamination concerns.

Several known air circulation systems have been designed to address the contamination concerns inherent in the utilization of direct fired burners. One type of known air circulation system utilizes damper positioning sensing to determine the percentage of recirculated air in the total air mass (known as the 'ventilation rate'), whereby the burner is controlled, in part, on the basis of the determined ventilation rate and the permissible equivalent temperature rise of the air mass before and after it has been treated by the burner. These damper positioning sensing ('DPS') systems typically utilize sensors to determine the physical position of louvers in the damper units which regulate the influx of outside air, as well as for determining the physical position of louvers in those damper units which regulate the influx of recirculated air. By sensing the physical position of louvers in each of the damper units, DPS systems can estimate how 'open' each damper unit is and thereby calculate the likely ventilation rate for the system as a whole. DPS systems do not, therefore, directly measure the air mass travelling through any of the damper units, rather these systems rely upon an indirect method for determining the air mass flow through each of the damper units in order to calculate the ventilation rate and subsequent control of the burner element.

As will be appreciated, the accuracy of DPS systems is intimately dependent upon the accuracy of the sensors in determining the actual, physical position of the louvers in the damper units. Should there exist problems with the structural integrity of the mechanical linkages in the damper units, or if there are any other environmental or structural complications, the sensors will misreport the actual position of the louvers, and hence, determination of the air mass moving through each of the damper units will be erroneously calculated. Moreover, the presence of dirty or blocked filters within a DPS system may also cause a miscalculation of the moving air mass, a miscalculation which DPS systems are unable to detect or compensate for.

It will therefore be readily apparent that determining the ventilation rate from the indirect sensing of an air mass moving through a damper unit, as in known DPS systems, is susceptible to a myriad of structural and environmental factors which detrimentally affect the accuracy of the system as a whole. In addition, the inaccuracy of DPS systems only tend to increase in magnitude the longer the systems are in use.

Other known systems, such as $CO_2$-based systems, exist to address the contamination concerns of direct-fired systems, however these systems also suffer from operational shortcomings due to the detrimental effect that altitude and humidity, amongst other environmental concerns, have on the accuracy of the system. Moreover, $CO_2$-based systems have inherently limited measurement ranges which typically require large amounts of outside air to be heated, thus raising operating and maintenance costs.

With the forgoing problems and concerns in mind, it is the general object of the present invention to provide an air circulation system which overcomes the above-described drawbacks and which ensures that air flow measurements are accurately and directly monitored in light of the temperature rise in the supply air stream, thereby systematically controlling the harmful build-up of combustion by-products in the circulating air mass.

SUMMARY OF THE INVENTION

It is an object of the present invention to provide an air circulation system.

It is another object of the present invention to provide an air circulation system which recirculates a selected portion of the air within a building environment.

It is another object of the present invention to provide an air circulation system which utilizes a direct-fired heating unit.

It is another object of the present invention to provide an air circulation system which effectively restricts the build-up of combustion by-products to within a predetermined safety range.

It is another object of the present invention to provide an air circulation system which effectively restricts the build-up of combustion by-products to within a predetermined safety range by limiting the allowable temperature rise through the system.

It is another object of the present invention to provide an air circulation system which utilizes sensor arrays and an automated controller to effectively restrict the build-up of combustion by-products to within a predetermined safety range.

It is another object of the present invention to provide an air circulation system which automatically and periodically self-calibrates itself to ensure maximum efficiency and safety.

It is another object of the present invention to provide an air circulation system which automatically and periodically self-calibrates itself while accounting for current structural conditions of the system.

It is another object of the present invention to provide an air circulation system which is capable of parallel consideration of different operational parameters.

It is another object of the present invention to provide an air circulation system which is capable of prioritizing different operational parameters.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
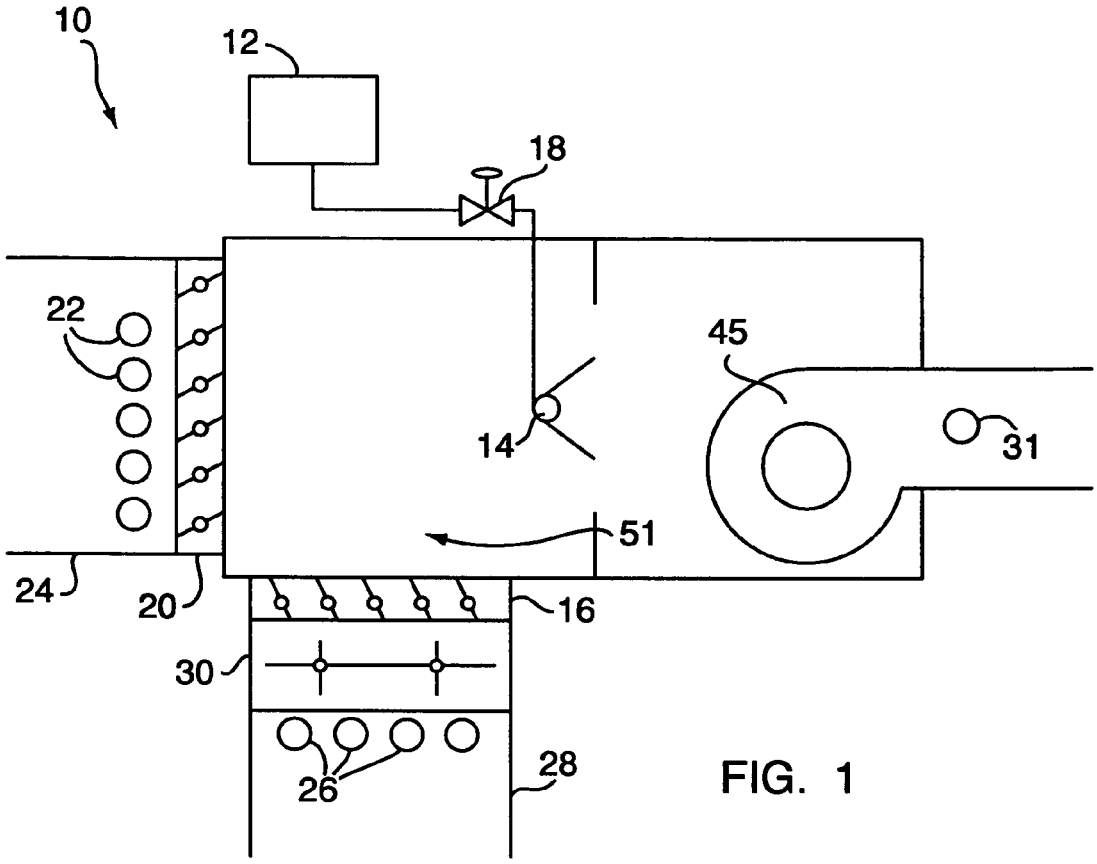
FIG. 1 is a schematic diagram illustrating an air circulation system, according to one embodiment of the present invention.

FIG. 1 is a schematic illustration of an air circulation system 10, according to one embodiment of the present invention. As shown in FIG. 1, the air circulation system 10 includes a controller 12, a heating unit 14 and a return damper apparatus 16. The heating unit 14 itself includes a gas valve 18, which selectively regulates the influx of fuel, typically hydrocarbon fuel or the like, to a burner component of the heating unit 14. In this regard, one function of the controller 12 is to control the operation of the gas valve 18, in accordance with either a manual input, automatic control, or in relation to pre-set operational parameters.

It will be readily appreciated that the controller 12 may be comprised of either a manual input keyboard and display screen, or an internalized computer and associated subroutine, or both, without departing from the broader aspects of the present invention.

Returning to FIG. 1, an outside air-metering device 20 is utilized to provide the air circulation system 10 with a variable amount of 'fresh' outside air ('0A'); that is, air which has not previously circulated through the air circulation system 10. The outside air-metering device 20 may be any type of known damper, louver/damper apparatus or the like without departing from the broader aspects of the present invention.

A plurality of sensor arrays are also shown in FIG. 1 and serve to relate critical data concerning the temperature and volume of the air mass being processed by the air circulation system 10, at any given time, to the controller 12. Incoming air temperature sensor 22, which may be a single sensor or, preferably, an array of individual sensors, is oriented along an outside air duct 24 and monitors the temperature of the incoming air provided to the outside air-metering device 20. Returning air temperature sensor 26, which may be a single sensor or, preferably, an array of individual sensors, is oriented along a return duct 28 and monitors the temperature of the recirculated air provided to the return damper apparatus 16.

Oriented before the return damper apparatus 16 and the heating unit 14 is an air pressure sensor 30. The air pressure sensor 30 is preferably utilized to monitor pressure of the return air mass provided to the heating unit 14 and employs pressure transducers or the like to convert the detected air pressure to an electrical signal indicative of the return air mass which is provided to the heating unit 14. In addition, a discharge air temperature sensor 31 is disposed downstream of the heating unit 14 and serves to monitor the discharge air temperature of the air mass leaving the heating unit 14. Both the air pressure sensor 30 and the temperature sensor 31 may be comprised of a single sensor or, preferably, an array of individual sensors without departing from the broader aspects of the present invention.

Figure 2:
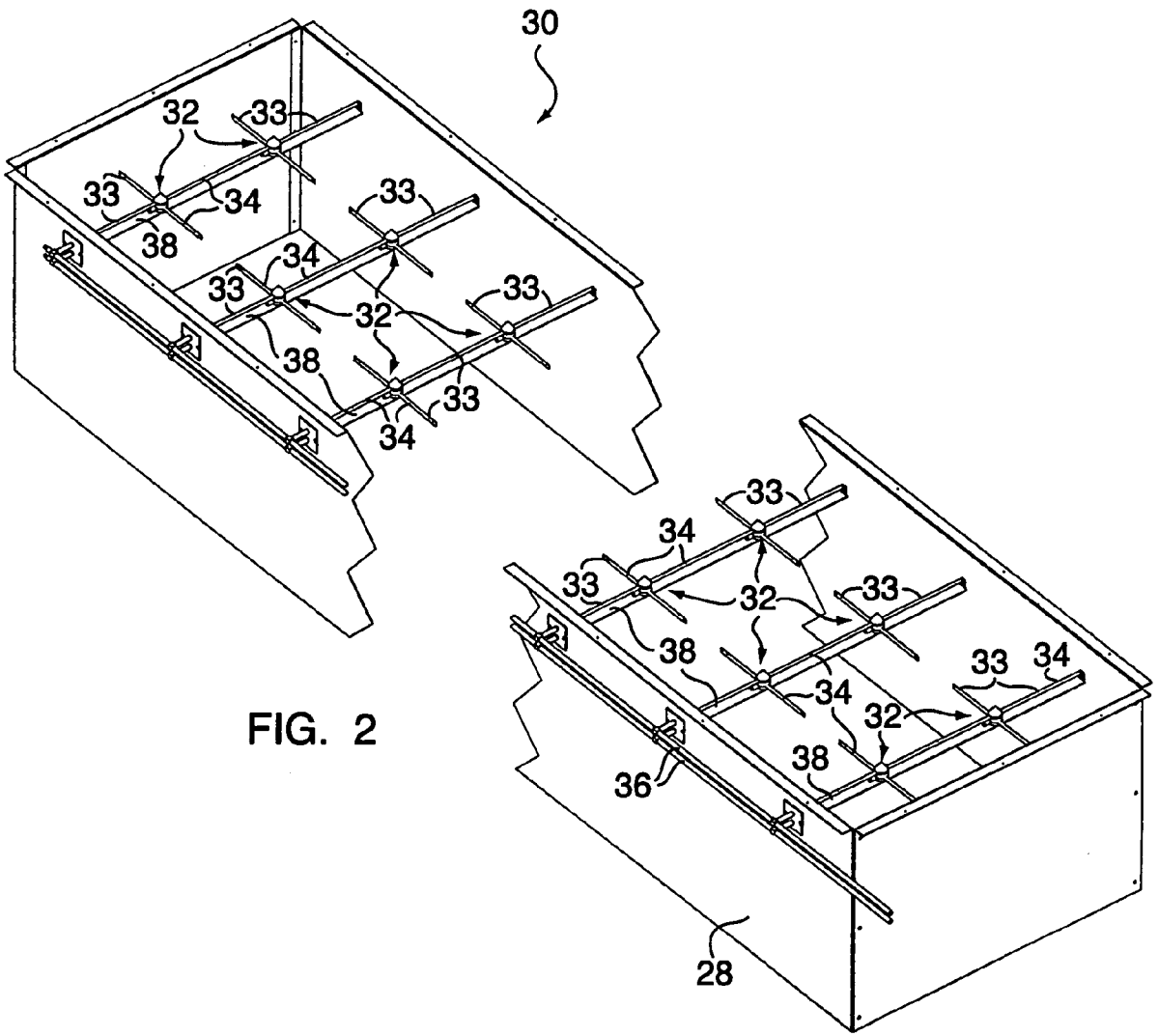
FIG. 2 illustrates an array of air pressure units integrated with the air circulation system of FIG. 1.

The air pressure sensor 30 of FIG. 1 is preferably constructed as an array of operatively connected air pressure units 32 which are oriented in a grid pattern, shown in FIG. 2, thereby enabling the air pressure units 32 to receive, in aggregate, an accurate and direct detection of the air mass moving through the return duct 28 at any given time. The air pressure units 32 include a plurality of detection apertures 33 formed in substantially hollow tubes, into which the moving air mass is incident. Moreover, the air pressure units 32 are integrated with one another via substantially hollow collection tubes 34, depicted most clearly in FIG. 3, which themselves are channeled into substantially hollow manifold tubes 36.

The information detected by the air pressure units 32 is subsequently communicated by the manifold tubes 36 to the controller 12 after the appropriate signal interpretation, via pressure transducers or the like, has occurred. As will be appreciated, by utilizing the air pressure units 32, and the associated substantially hollow tubing, the present invention may accurately and passively record the air flow through the return duct 28 without employing any moving parts, thus reducing the incident of mechanical wear and failure and the associated maintenance and replacement costs.

Figure 3:
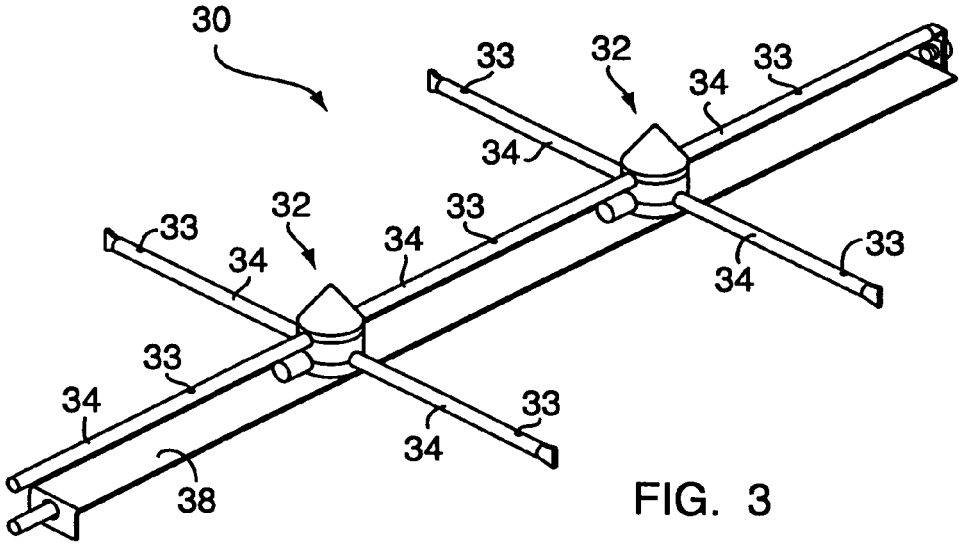
FIG. 3 illustrates a pair of air pressure units mounted in conjunction with an amplification baffle.

As further shown in FIG. 3, the air pressure units 32 may be selectively coupled to an amplifying baffle 38 in order to provide accurate readings even when the volume of the circulating air mass is relatively low. That is, the amplifying baffle 38 serves to create turbulence in the movement of even a small amount of air adjacent the detection apertures 33 as the air moves through the return duct 28, thereby enabling the detection apertures 33 to capture and record such air mass movement.

The air pressure units 32 are preferably spaced every 6 to 12 inches over the entire face of the return duct 28 in order to obtain an accurate measurement. Moreover, the volume of the air mass detected by each of the air pressure units 32 in the sensor array 30 are averaged, conditioned and interpreted by the controller 12 to calculate the ventilation rate of the air circulation system 10. As will be appreciated, by employing multiple velocity pressure sensor points, in the form of the array of air pressure units 32, the present invention ensures a highly accurate measurement of the total airflow through the return duct 28.

It is therefore an important aspect of the present invention that the volume of the air mass moving through the return duct 28 is directly calculated via the air pressure units 32, in stark contrast to the DPS and $CO_2$ systems previously discussed which utilize indirect calculation and determination of the moving air mass. It will be readily appreciated that by directly sensing the volume of the air mass moving through the return duct 28, the air circulation system 10 returns highly accurate measurements to the controller 12, thus resulting in highly accurate ventilation rates for use in controlling the burner 14, as will be discussed in more detail later. Indeed, laboratory analysis of the sensor array 30 has proven that the direct measurement of the air mass moving through the return duct 28 at any given time to be extremely repeatable and accurate to within 4%.

It is another important aspect of the present invention that the automatic self-calibration function of the air circulation system 10 is independent of the structural integrity of the air circulation system 10 in providing accurate measurements upon which to base future decisions regarding operation and modulation of the burner component of the heating unit 14, as well as the damper apparatuses 16/20. Thus, the air circulation system 10 of the present invention ensures that the controller 12 is capable of accurately monitoring the composite airflows within the air circulation system 10 regardless of the presence of dirty filters, broken damper linkages, or the like. In this regard, the automatic self-calibration function of the air circulation system 10 is highly adaptive to any changes in the overall system, while also being capable of compensating for any such changes automatically with each self-calibrating operation.

Another important aspect of the present invention is that the air circulation system 10 may be selectively controlled so as to initiate a self-calibration operation on a set timetable, such as but not limited to once a day or month, or rather in response to environmental criteria, such as but not limited to the inside air temperature, the outside air temperature, or the difference between the two.

Indeed, the present invention achieves its high accuracy at least in part due to the ability of the air circulation system 10 to self-calibrate itself at a time period after installation, as opposed to being calibrated in the factory or lab prior to installation, thus avoiding the need for the application of corrective factors or routines.

It is another important aspect of the present invention that the air circulation system 10 is capable of maintaining highly accurate measurements of the air mass moving through the return duct 28 even when the air mass is extremely small in magnitude, via the employment of the amplifying baffles 38, as best seen in FIG. 3. Such an ability renders the present invention especially applicable to those situations where installation in low ambient pressure environments is desired.

Figure 4:
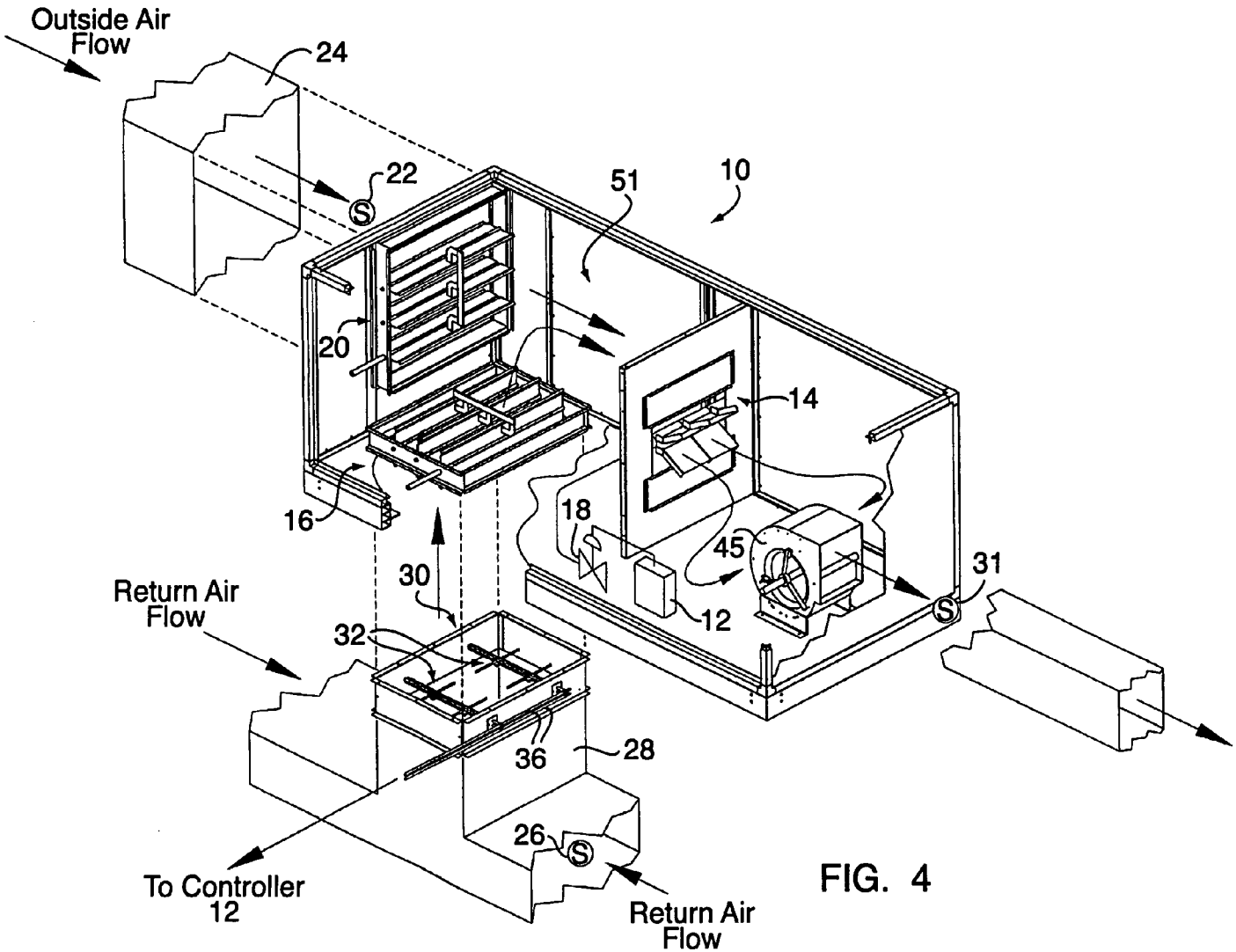
FIG. 4 is a partially cut-away illustration of the air circulation system depicted in FIG. 1.
Figure 5:
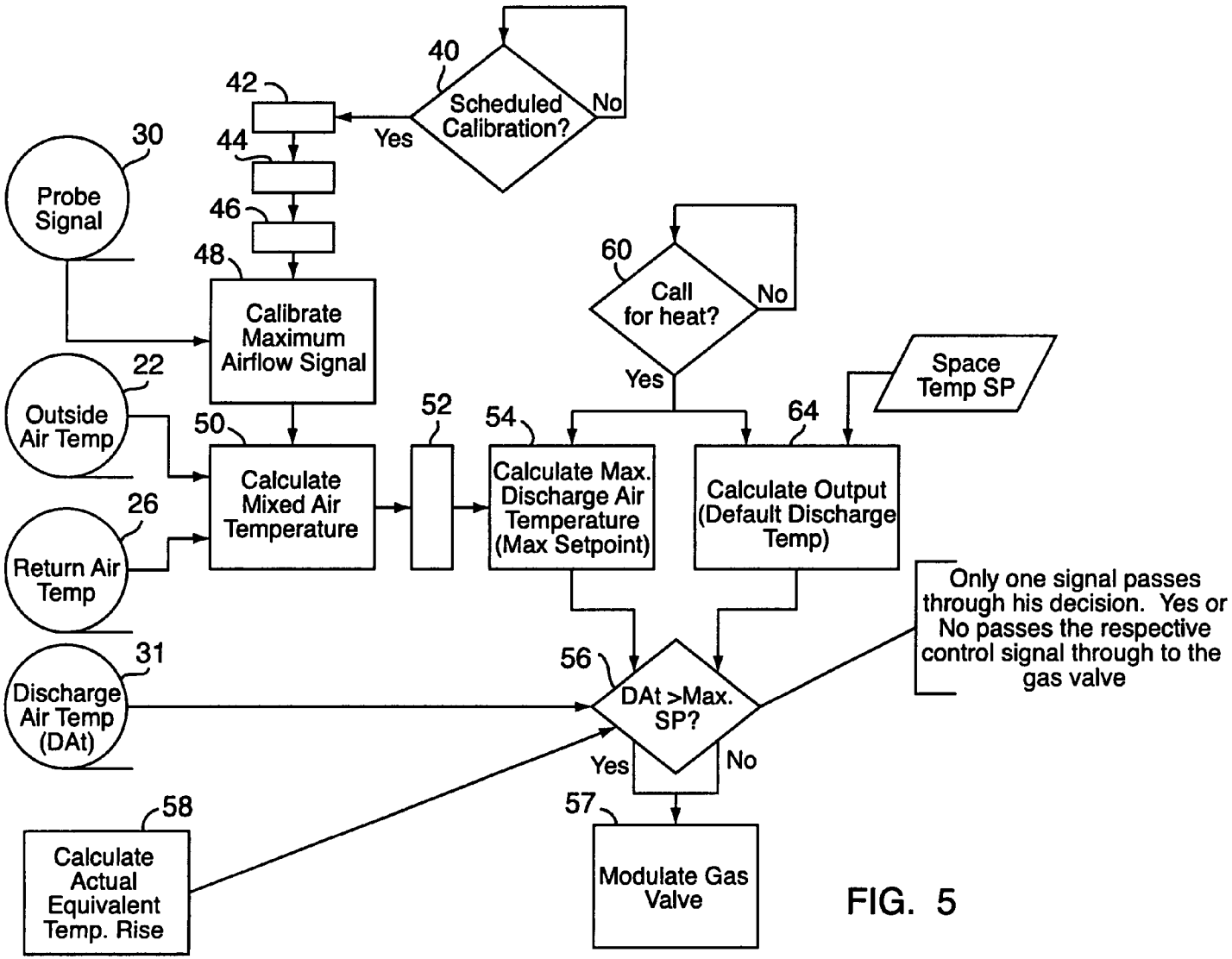
FIG. 5 is an operational flow diagram illustrating the temperature detection, computation of ventilation rate and control of the temperature rise in the air circulation system, according to one embodiment of the present invention.

The operation of the air circulation system 10 will now be generally described in conjunction with a partially cut-away illustration of the air circulation system 10 depicted in FIG. 4 and the operational flow diagram of FIG. 5. As shown in FIG. 4, the air circulation system 10 controls the temperature rise between the air mass entering the heating air unit 14 and air mass leaving the heating unit 14, relative to the amount of recirculated air, that is, the ventilation rate, provided to the return damper apparatus 16, by selectively attenuating or closing the gas valve 18, as will be described hereinafter.

At the first stage of operation, the air circulation system 10 must self-calibrate itself in order to have a base line against which the subsequent readings of the various sensor arrays may be compared. At the initiation of the self-calibration routine, as shown in the operational flow diagram of FIG. 5, it is decided in step 40 whether the self-calibration routine is scheduled. If 'no', then the controller 12 does not perform the self-calibration and, if 'yes', the controller 12 permits the self-calibration routine to continue. Although the air circulation system 10 has been described utilizing a scheduled self-calibration operation, the present invention is not so limited in this regard as the self-calibration operation may be repeatedly performed on a daily or weekly basis, as automatically scheduled in advance, or in relation to predetermined changes in temperature fluctuations, weather conditions or other design criteria without departing from the broader aspects of the present invention.

Returning to FIGS. 4 and 5, after the controller 12 has determined that the self-calibration should continue, it is necessary to isolate the air circulation system 10 from the outside air in order to obtain a base reading so as to calculate the ventilation rate of the air circulation system 10 in the future. In step 42, therefore, the controller 12 drives the outside air-metering device 20 to completely shut off the supply of outside air from the air circulation system 10, while in step 44 the return damper apparatus 16 is driven to its fully open position, thus ensuring that 100% of the air mass moving through the air circulation system 10 is recirculated air. In addition, although not represented in FIG. 5, the controller will also ensure both that the heating unit 14 is off, and that the blower 45 is on. A predetermined time delay is then instituted in step 46 to allow the air circulation system 10 to stabilize. A time of delay of a few minutes, preferably 3-5 minutes, is typically employed, however the time delay may be adjusted in conformance with the size, and type, of ductwork involved without departing from the broader aspects of the present invention.

Once the time delay of step 46 has expired, the air pressure sensor 30 communicates the volume of the air mass moving through the return duct 28 to the controller 12 where these values are then averaged, conditioned and interpreted in step 48 by the controller 12 to determine a peak airflow signal at a 100% ventilation rate. This peak airflow signal ($P_{peak}$) is stored by the controller 12 as a constant and is utilized during operation of the air circulation system 10 to determine the operating ventilation rate, as will be described in more detail later. The return damper apparatus 16 and the outside air-metering device 20 will then be returned to their normal state of operation. By comparing the output from the air pressure sensor 30 at the time of self-calibration, with the output of the air pressure sensor 30 during those times when the dampers in the return damper apparatus 16 are operating normally, the controller 12 is able to accurately compute, and control, the ventilation rate of the system 10; that is, the controller 12 is able to accurately compute, and control, the percentage of recirculated air to the total air mass moving through the air circulation system 10.

Therefore, assuming: %RA=percent of return air (ventilation rate);

%OA=percent of outside air;

$P_{peak}$=stored peak airflow value; and $P_{actual}$=output of sensor 30 during normal operation. The controller 12 may then calculate the actual ventilation rate of the air circulation system 10 at any time utilizing the equation:

$$\%RA=\sqrt{(P_{actual}/P_{peak})}*100.$$

As will be appreciated, the controller 12 can then calculate the actual percent of outside air at any time utilizing the equation:

$$\%OA=100-\%RA.$$

Returning to FIG. 5, step 50 represents the calculation of the mixed air temperature of the air mass in area 51 of the air circulation system 10, prior to treatment of the mixed air mass by the heating unit 14. As depicted at step 50, the controller 12 utilizes information from the incoming air temperature sensor 22 and the returning air temperature sensor 26, in conjunction with the previously determined ventilation rate (%RA) to calculate the mixed air temperature (MAt) of the air mass in area 51 as follows:

$$MAt=((OAt*\%OA)/100)+((RAt*\%RA)/100);$$

where OAt=outside air temperature (from sensor 22); and

RAt=return air temperature (from sensor 26).

As alluded to previously, an important aspect of the present invention is for the controller 12 to control the operation of the heating unit 14 such that, in light of a directly detected ventilation rate (%RA), concentrations of post-combustion contaminants are not permitted to exist in the air stream of the air circulation system 10 in levels that would exceed manufacturer, industry, or governmental standards. It is therefore vital that the controller 12 first calculate the mixed air temperature (MAt) as discussed above. It is also necessary for the controller 12 in step 52 to calculate the maximum equivalent temperature rise (MaxEQΔT); that is, for a given ventilation rate (%RA), it is necessary to calculate the maximum equivalent temperature rise of the mixed air mass as it moves from its position prior to the heating unit 14 in area 51, to that portion of the air circulation system 10 after the heating unit 14, as follows:

MaxEQΔT=(%OA*50)/(19.63*K); where K is the gas constant of the fuel utilized by the heating unit 14.

Utilizing, then, the values previously calculated as discussed above, the controller 12 then calculates the maximum discharge air temperature (MaxDAt) in step 54, as follows:

$$MaxDAt=MAt+MaxEQ\Delta T.$$

As its name suggests, the maximum discharge air temperature (MaxDAt) is that temperature which the air mass leaving the heating unit 14 must not exceed, taking in consideration the specific mixed air temperature (MAt) and the directly detected ventilation rate (%RA) of the air circulation system 10 at any given time. It is now left to the controller 12, in step 56, to compare the maximum discharge air temperature (MaxDAt) with the discharge air temperature (DAt) as reflected by the value of the discharge air temperature sensor 31.

As shown in FIG. 5, the controller 12 outputs one of two possible commands in step 56 to the gas valve 18 where, in step 57, the controller 12 causes the gas valve 18 to shut off, or otherwise modulate, the supply of fuel to the heating unit 14 if the discharge air temperature (DAt) is greater than the maximum discharge air temperature (MaxDAt).

It is therefore an important aspect of the present invention that the controller 12 is capable of directly monitoring the actual ventilation rate of the air circulation system 10 and is thereby capable of ascertaining if the discharge air temperature (DAt) is impermissibly greater than the maximum discharge air temperature (MaxDAt) given the detected ventilation rate. That is, the air circulation system 10 of the present invention directly monitors the operating parameters of the system 10 to ensure that a harmful concentration of post-combustion contaminants is never permitted to exist in the air stream of the air circulation system 10.

While the controller 12 may selectively modulate the gas valve 18 if the discharge air temperature (DAt) is impermissibly greater than the maximum discharge air temperature (MaxDAt), the present invention also contemplates controlling the heating unit 14 in accordance with other salient operating parameters. As shown in FIG. 5, the controller 12 also calculates, in step 58, the actual equivalent temperature rise (ActEQΔT); that is, for a given ventilation rate (%RA), it is necessary to calculate the actual equivalent temperature rise of the mixed air mass as it moves from its position prior to the heating unit 14 in area 51, to that portion of the air circulation system 10 after the heating unit 14, as follows:

$$ActEQ\Delta T=[((\%OA*(DAt-OAt))/100]+[((\%RA*(DAt-RAt))/100];$$

where

DAt is the discharge air temperature value from sensor 31, OAt is the outside air temperature value from sensor 22, and RAt is the air temperature value from sensor 26.

Should the controller 12 determine, in step 56, that the actual equivalent temperature rise (ActEQΔT) exceeds the maximum equivalent temperature rise (MaxEQΔT), the controller 12 will output an appropriate command, in step 57, to the gas valve 18 thereby shutting off, or otherwise modulating the gas-firing rate, the supply of fuel to the heating unit 14. As will be appreciated, the permissible maximum temperature rise as dictated by the ratio of the recirculated air mass to the outside air mass will be stored in the memory of the controller 12 and may be manually entered or, alternatively, may be fashioned to meet industry or governmental standards, such as but not limited to ANSI regulation Z83.18.

It is therefore another important aspect of the present invention that the air circulation system 10 will, in a preferred embodiment, issue a command to the gas valve to shut off the supply of fuel to the heating unit 14, if: 1) The discharge air temperature (DAt) exceeds the calculated maximum discharge air temperature (MaxDAt) for a directly measured ventilation rate; or 2) The actual equivalent temperature rise (ActEQΔT) exceeds the maximum equivalent temperature rise (MaxEQΔT) for a directly measured ventilation rate. As considered hereinafter, these conditions may be collectively referred to as the Ventilation Control parameters for the air circulation system 10.

Another important aspect of the present invention is the parallel consideration by the controller 12 of additional factors surrounding the operation of the heating unit 14. Returning to FIG. 5, it can be seen that step 60 indicates if there exists a call for heat, via an automatic thermostat or the like, in the environment serviced by the air circulation system 10. If so, and in addition to the calculation of the various parameters discussed previously, the controller 12 will also look to a space temperature set point, in step 62, to determine what specific temperature must be achieved. The controller 12 then determines, in step 64, if the temperature set point detected in step 62 is greater than the discharge air temperature (DAt). If not, the controller 12 passes a signal to step 56 indicating that the gas valve 18 should be modulated to increase the heating capacity of the heating unit 14. It should be noted, however, that the command from the controller 12 to increase the heating capacity of the heating unit 14, when such an action is indicated by the determination in step 64, is conditional upon the status of the Ventilation Control parameters, as will be explained below.

As indicated earlier, the air circulation system 10 of the present invention directly monitors the operating parameters of the system 10 to ensure that a harmful concentration of post-combustion contaminants are never permitted to exist in the air stream of the air circulation system 10. In this regard, it is another important aspect of the present invention that the controller 12 prioritizes its determination of the Ventilation Control parameters over any call for heat which may be issued in step 60 or any determination in step 64. Thus, the controller 12 of the present invention ensures that the gas valve 18 will not supply the heating unit 14 with fuel should the Ventilation Control parameters indicate that the air circulation system 10 is exceeding its post-combustion guidelines, even when the call for heat in step 60 and the determination in step 64 request actions to the contrary.

It is therefore another important aspect of the present invention that the controller 12 does not permit calls for heat, which may be either manually or automatically initiated, to take precedence over the safety concerns embodied by any regulatory limits upon which the operation of the air circulation system 10 may be based.

In the preferred embodiment of the present invention, a predetermined minimum ventilation rate may be maintained. That is, the preferred embodiment of the present invention is operable to maintain an influx of a predetermined percentage of outside air in the total airflow being circulated through the air circulation system 10. Moreover, the preferred embodiment of the present invention permits at least three options, at the discretion of the operator of the controller 12, for controlling the damper elements of both the return damper apparatus 16 and the outside air metering device 20 in order to selectively vary the ventilation rate.

In particular, an operator may instruct the controller 12 to:

1) Automatically control the ventilation rate (%RA) in accordance with maintaining building pressure. With this control regimen, a pressure transducer, or the like, may be mounted in a suitable location for measuring the pressure inside the building in relation to the pressure outside the building. The damper elements of both the return damper apparatus 16 and the outside air metering device 20 may then be automatically positioned by the controller 12 to maintain a building pressure set-point entered into the controller 12 by the operator;

2) Manually control the ventilation rate (%RA) by manually positioning the damper elements of both the return damper apparatus 16 and the outside air metering device 20 to an arbitrary position as selected by the operator; and 3) Automatically control the ventilation rate (%RA) in accordance with a mixed air temperature set point. With this control regimen, the damper elements of both the return damper apparatus 16 and the outside air metering device 20 may be automatically positioned by the controller 12 to maintain a predetermined mixed air temperature (MAt), as calculated by the controller 12.

Figure 6:
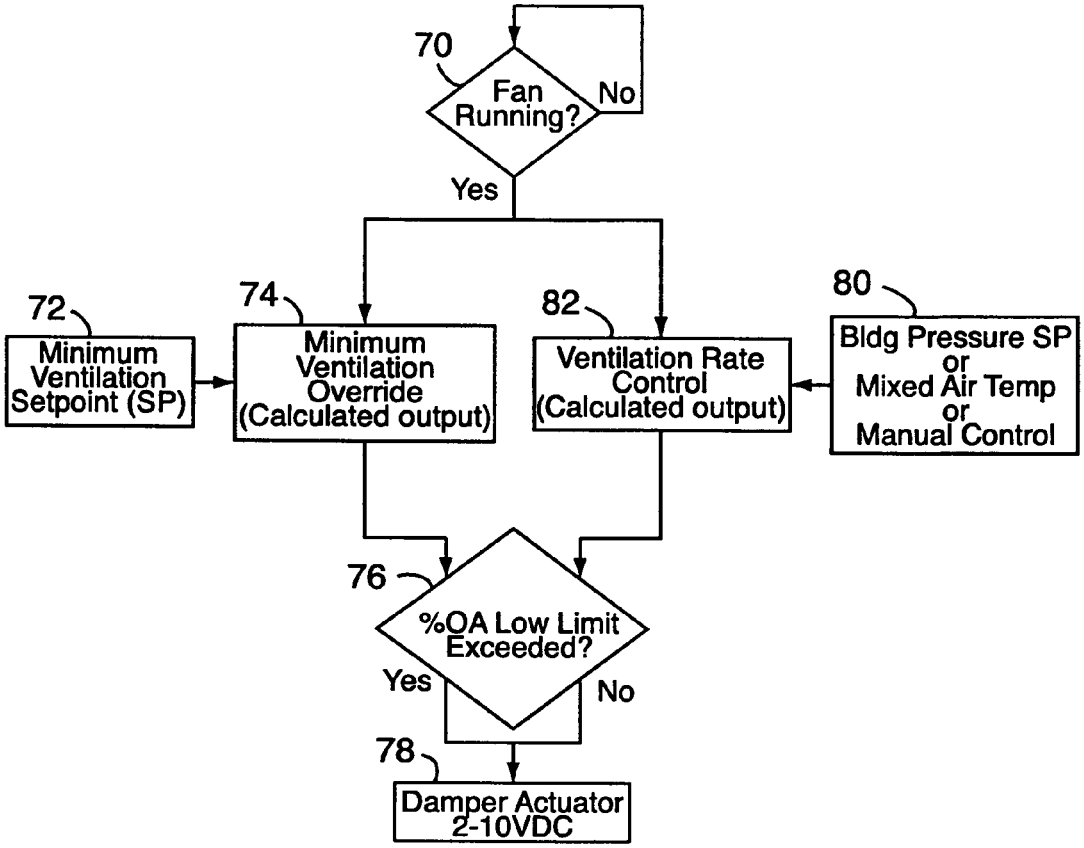
FIG. 6 is a damper control flow diagram for the air circulation system.

FIG. 6 is a damper control flow diagram for the air circulation system 10 which illustrates the control of the damper elements of both the return damper apparatus 16 and the outside air metering device 20 for each of the preceding three control regimens. As shown in FIG. 6, the controller 12 first determines if the blower 45 is running in step 70. If so, the controller 12 monitors parallel command architectures to determine the proper adjustment of the damper elements of both the return damper apparatus 16 and the outside air metering device 20.

One branch of the command architecture illustrated in FIG. 6 involves the controller 12 determining, in step 72, a predetermined ventilation rate set point. The ventilation rate set-point may be selected, for example, to be 20%, however it should be readily appreciated that any predetermined ventilation rate may be alternatively selected without departing from the broader aspects of the present invention.

The controller 12 next determines, in step 74, the actual ventilation rate (%RA) in accordance with the equation for the same, as discussed previously in conjunction with FIG. 5. Step 76 reflects the controller 12 determining if the actual ventilation rate is lower than the ventilation rate set point. If so, a command is issued to suitably adjust the damper elements, in step 78, of both the return damper apparatus 16 and the outside air metering device 20 to bring the ventilation rate back above the ventilation rate set-point.

In concert with the processing of this first branch, the other branch of the command architecture illustrated in FIG. 6 involves the controller 12 determining, in step 80, which one of the three control regimens have been selected by an operator. Regardless of the control regimen selected, the controller 12 next determines, in step 82, the actual value of the specific criteria utilized by each of the control regimens. That is, in step 82, the controller 12 determines what the actual building pressure is, what position the dampers have been manually set to and the corresponding ventilation rate, or what the actual mixed air temperature is, in dependence upon the control regimen selected by the operator. Step 76 again reflects a determination by the controller 12 as to whether the specific criteria expressed by the selection of a specific control regimen has been met. A command is then issued to suitably adjust the damper elements, in step 78, of both the return damper apparatus 16 and the outside air metering device 20 to bring the specific criteria of the selected control regimen in line with its predetermined value.

Similar to the parallel practice of the controller 12 previously discussed in conjunction with FIG. 5, it is another important aspect of the present invention that the controller 12 prioritizes its determination of the ventilation rate set-point, in step 72, over any of the control regimens expressed in step 80 or any associated determination in step 76. Thus, the controller 12 of the present invention ensures that any predetermined ventilation rate set-point is maintained, even when a particular control regimen has been selected in step 80 which may otherwise wish to control the damper elements differently.

Figure 7:
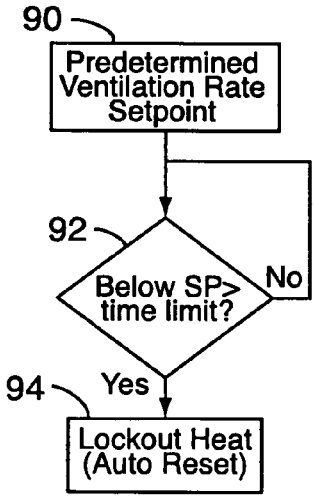
FIG. 7 is a safety flow diagram for the air circulation system.

In addition to controlling the damper elements of both the return damper apparatus 16 and the outside air metering device 20, in accordance with a ventilation rate set-point or another control regimen, the controller 12 of the present invention may also be adapted to shut down the burner component of the heating unit 14 if the ventilation rate is below a predetermined ventilation rate set-point for a predetermined period of time. FIG. 7 illustrates a predetermined ventilation rate set point in step 90, whereas the actual ventilation rate is continually monitored by the controller 12. The controller 12 determines, in step 92, whether the actual ventilation rate has been below the predetermined ventilation rate set point for more than, in this instance, 3 minutes. If so, the controller 12 issues a command to the heating unit 14 to shut down the burner and re-set the system. It will be appreciated that the specific values for the predetermined ventilation rate set-point expressed in step 90, and the predetermined time period utilized by the controller 12 in step 92, may be

What is claimed is:

1. An air circulation system having ductwork for use in managing a controlled space, said air circulation system comprising:

an outside air duct for presenting an outside air stream to said controlled space;

a return air duct for presenting a return air stream to said controlled space, said return air stream comprising air previously circulated through said controlled space and mixing with said outside air stream prior to said outside air stream and said return air stream being presented to said controlled space;

a controller;

a return damper apparatus operatively connecting said return air duct to said ductwork;

a heating unit;

an air mass sensor for selectively and directly detecting only a ventilation rate of said return air stream moving through said return damper apparatus and communicating said ventilation rate to said controller;

a discharge temperature sensor for detecting a temperature of air discharged from said heating unit; and wherein said controller selectively modulates operation of said heating unit in dependence upon said ventilation rate and said discharged air temperature.

2. A method of operating an environmental control system having ductwork for use in managing environmental conditions within a controlled space, said ductwork including an outside air damper for controlling an influx of an outside air stream to said controlled space, a return air damper for controlling an influx of a return air stream to said controlled space, said return air stream comprising air previously circulated through said controlled space, and an air mass sensor oriented adjacent to said return damper apparatus, said method comprising the steps of:

isolating said ductwork from the influx of outside air by closing said outside air damper;

fully opening said return damper;

ensuring that a blower of said environmental control system is on;

waiting a predetermined time period for said environmental control system to stabilize; and utilizing said air mass sensor to determine a total volume of air moving through said return damper, said air mass sensor generating a peak airflow signal corresponding to said total volume of air and outputting said peak airflow signal to a controller of said environmental control system;

utilizing said peak airflow signal to determine a ventilation rate of said environmental control system when said outside air damper is reopened; and controlling operation of a heating unit in said environmental control system on the basis of said ventilation rate.

3. A method of calibrating an environmental control system having ductwork for use in managing environmental conditions within a controlled space, said ductwork including an outside air damper for controlling an influx of an outside air stream to said controlled space, a return air damper for controlling an influx of a return air stream to said controlled space, said return air stream comprising air previously circulated through said controlled space, and an air mass sensor oriented adjacent to said return damper apparatus, said method comprising the steps of:

isolating said ductwork from the influx of outside air by closing said outside air damper;

fully opening said return damper;

ensuring that a blower of said environmental control system is on;

waiting a predetermined time period for said environmental control system to stabilize;

utilizing said air mass sensor to determine a total volume of air moving through said return damper; and causing said air mass sensor to generate a peak airflow signal corresponding to said total volume of air and outputting said peak airflow signal to a controller of said environmental control system.

4. The method of calibrating an environmental control system according to claim 3 said method further comprising the steps of:

averaging a plurality of said peak airflow signals; and outputting said averaged peak airflow signals to said controller of said environmental control system.

5. A method of controlling an air circulation system having ductwork for use in managing a controlled space, said method comprising the steps of:

utilizing an outside air duct for presenting an outside air stream to said controlled space;

utilizing a return air duct for presenting a return air stream to said controlled space, said return air stream comprising air previously circulated through said controlled space and mixing with said outside air stream prior to said outside air stream and said return air stream being presented to said controlled space;

orienting a return damper apparatus to operatively connect said return air duct to said ductwork;

orienting an air mass sensor adjacent to said return damper apparatus;

selectively utilizing said air mass sensor to directly detect a ventilation rate of said return air stream moving through said return damper apparatus;

detecting a discharge temperature of air discharged from said heating unit; and communicating said detected ventilation rate to a controller of said air circulation system, wherein said controller selectively modulates operation of said heating unit in dependence upon said detected ventilation rate and said discharge temperature.

6. The air circulation system according to claim 3, wherein:

said temperature means comprises an ambient temperature sensor for detecting a temperature of air moving through said outside air duct, a return temperature sensor for detecting a temperature of air moving through said return air duct, and a discharge temperature sensor for detecting a temperature of air discharged from said heating unit;

and wherein said ambient temperature sensor and said return temperature sensor are each oriented prior to said heating unit.

7. The air circulation system according to claim 1, wherein:

said air mass sensor is disposed immediately adjacent to said return damper apparatus and comprises an array of air pressure units each having a plurality of apertures associated therewith for capturing a portion of said air moving through said return damper apparatus, as well as an amplification baffle oriented adjacent one of said apertures; and said array of air pressure units are substantially oriented in a grid pattern.

8. The air circulation system according to claim 7, wherein:

said heating unit comprises a direct-fired burner apparatus.

9. The air circulation system according to claim 1, wherein:

said air mass sensor repeats said direct detection of said ventilation rate in accordance with one of a periodic schedule, an environmental parameter and a command inputted to said controller.

10. The method of controlling an air circulation system according to claim 4, said method further comprising the steps of:

calculating said actual temperature rise utilizing data from an ambient temperature sensor for detecting a temperature of air moving through said outside air duct, a return temperature sensor for detecting a temperature of air moving through said return air duct, and a discharge temperature sensor for detecting a temperature of air discharged from said heating unit.

11. The method of controlling an air circulation system according to claim 5, said method further comprising the steps of:

orienting an outside damper apparatus to operatively connect said outside air duct to said ductwork; and closing said outside damper apparatus prior to detecting said detected ventilation rate.

12. The method of controlling an air circulation system according to claim 5, said method further comprising the steps of:

determining when activation of said heating unit is requested for said air circulation system;

activating said heating unit when said controller has determined that activation of said heating unit has been requested, said controller permitting said activation only when said activation does not conflict with said controller's selective modulation of said heating unit in dependence upon said detected ventilation rate.

13. The method of controlling an air circulation system according to claim 5, said method further comprising the steps of:

orienting an outside damper apparatus to operatively connect said outside air duct to said ductwork;

selectively modulating operation of said heating unit so as to maintain a predetermined ventilation rate;

determining whether said detected ventilation rate falls below said predetermined ventilation rate; and modulating one of said return damper apparatus and said outside damper apparatus when said detected ventilation rate has been determined to have fallen below said predetermined ventilation rate.

14. The method of controlling an air circulation system according to claim 13, said method further comprising the steps of:

determining when modulation of one of said return damper apparatus and said outside damper apparatus is requested to maintain a predetermined internal building pressure;

modulating one of said return damper apparatus and said outside damper apparatus when said controller has determined that modulation of one of said return damper apparatus and said outside damper apparatus has been requested to maintain a predetermined internal building pressure, said controller permitting said modulation only when it has been determined that said detected ventilation rate has not fallen below said predetermined ventilation rate.

15. The method of controlling an air circulation system according to claim 13, said method further comprising the steps of:

calculating an actual mixed air temperature of a combination of said return air stream moving through said return damper apparatus and said outside air stream moving through said outside damper apparatus;

determining when modulation of one of said return damper apparatus and said outside damper apparatus is requested to maintain a predetermined mixed air temperature; and modulating one of said return damper apparatus and said outside damper apparatus when said controller has determined that modulation of one of said return damper apparatus and said outside damper apparatus has been requested to maintain a predetermined mixed air temperature, said controller permitting said modulation only when it has been determined that said detected ventilation rate has not fallen below said predetermined ventilation rate.

16. The method of controlling an air circulation system according to claim 13, said method further comprising the steps of:

determining when manual manipulation of said controller has been initiated to modulate one of said return damper apparatus and said outside damper apparatus; and modulating one of said return damper apparatus and said outside damper apparatus when said controller has determined that said manual manipulation has been initiated, said controller permitting said modulation only when it has been determined that said detected ventilation rate has not fallen below said predetermined ventilation rate.

17. The method of controlling an air circulation system according to claim 5, said method further comprising the steps of:

selectively modulating operation of said heating unit so as to maintain a predetermined ventilation rate;

determining whether said detected ventilation rate falls below said predetermined ventilation rate; and disabling said heating unit when said detected ventilation rate has been determined to have fallen below said predetermined ventilation rate for a predetermined time period.

18. The method of controlling an air circulation system according to claim 5, said method further comprising the steps of:

utilizing a direct-fired burner apparatus as an element of said heating unit.

19. The method of controlling an air circulation system according to claim 5, said method further comprising the steps of:

repeating said direct detection of said ventilation rate in accordance with one of a periodic schedule, an environmental parameter and a command inputted to said controller.

20. An air circulation system for managing an outside air stream and a return air stream in a controlled environment, said air circulation system comprising:

a controller;

a return damper apparatus operatively connecting said return air stream to said controlled environment;

a heating unit;

an air mass sensor mounted directly adjacent said return damper apparatus for selectively and directly detecting a ventilation rate of air moving into said controlled environment through said return damper apparatus and communicating said ventilation rate to said controller a discharge temperature sensor for detecting a temperature of air discharged from said heating unit; and wherein said controller selectively modulates operation of said heating unit in dependence upon said ventilation rate and said discharged air temperature.

21. The air circulation system according to claim 2 wherein:

said temperature means comprises an ambient temperature sensor for detecting a temperature of air in said outside air stream, a return temperature sensor for detecting a temperature of air in said return air stream, and a discharge temperature sensor for detecting a temperature of air discharged from said heating unit; and wherein said ambient temperature sensor and said return temperature sensor are each oriented at a location prior to said heating unit.

22. The air circulation system according to claim 20 wherein:

said air mass sensor comprises an array of air pressure units each having a plurality of apertures associated therewith for capturing a portion of said air moving through said return damper apparatus, as well as an amplification baffle oriented adjacent one of said apertures; and said array of air pressure units are substantially oriented in a grid pattern.

23. The air circulation system according to claim 22 wherein:

said heating unit comprises a direct-fired burner apparatus.

24. The air circulation system according to claim 20, wherein:

said air mass sensor repeats said direct detection of said ventilation rate in accordance with one of a periodic schedule, an environmental parameter and a command inputted to said controller.

25. A method of controlling an air circulation system for managing an outside air stream, a return air stream and a heating unit in a controlled environment, said method comprising the steps of:

orienting a return damper apparatus to operatively connect said return air stream to said controlled environment, said return air stream comprising air previously circulated through said controlled environment and mixing with said outside air stream prior to said outside air stream and said return air stream being presented to said controlled environment;

orienting an air mass sensor adjacent to said return damper apparatus;

selectively utilizing said air mass sensor to directly detect only a ventilation rate of air moving through said return damper apparatus;

detecting a discharge temperature of air discharged from said heating unit; and communicating said detected ventilation rate to a controller of said air circulation system, wherein said controller selectively modulates operation of said heating unit in dependence upon said detected ventilation rate and said discharge temperature.

* * * * *